US010906618B2

(12) United States Patent
Stanley et al.

(10) Patent No.: US 10,906,618 B2
(45) Date of Patent: Feb. 2, 2021

(54) MARINE PROPULSION SYSTEM SUPPORTED BY A STRUT

(71) Applicant: ZF Friedrichshafen AG, Friedrichshafen (DE)

(72) Inventors: Keith Stanley, Coral Springs, FL (US); Andrew Orvieto, Plantation, FL (US); Dave Gruenwald, Oshkosh, WI (US); Bryan Danner, Oshkosh, WI (US)

(73) Assignee: ZF FRIEDRICHSHAFEN AG, Friedrichshafen (DE)

( * ) Notice: Subject to any disclaimer, the term of this patent is extended or adjusted under 35 U.S.C. 154(b) by 115 days.

(21) Appl. No.: 16/176,521

(22) Filed: Oct. 31, 2018

(65) Prior Publication Data

US 2020/0130794 A1 Apr. 30, 2020

(51) Int. Cl.

| | |
|---|---|
| ***B63H 5/10*** | (2006.01) |
| ***B63B 3/42*** | (2006.01) |
| ***B63H 1/14*** | (2006.01) |
| ***B63H 23/34*** | (2006.01) |

(52) U.S. Cl.

CPC ..... *B63H 5/10* (2013.01); *B63B 3/42* (2013.01); *B63H 1/14* (2013.01); *B63H 23/34* (2013.01); *B63H 2005/103* (2013.01)

(58) Field of Classification Search

CPC ..... B63H 2005/106; B63H 2020/006; B63H 2023/067; B63H 5/10

USPC ..... 441/82

See application file for complete search history.

(56) References Cited

U.S. PATENT DOCUMENTS

| | | | | |
|---|---|---|---|---|
| 5,017,168 | A | 5/1991 | Ackley | |
| 2020/0070944 | A1 * | 3/2020 | Stolper | B63H 23/02 |

FOREIGN PATENT DOCUMENTS

WO 2018/106288 A1 6/2018

* cited by examiner

*Primary Examiner* — Andrew Polay
(74) *Attorney, Agent, or Firm* — Davis & Bujold PLLC; Michael J. Bujold

(57) ABSTRACT

A marine propulsion system, supported by a strut, comprising an inner propeller shaft supporting a first propeller adjacent a trailing end thereof, and the inner propeller shaft is connected to the drive shaft for receiving and supplying a first portion of torque to the first propeller as well as transfer thrust, generated by the first propeller, along the inner propeller shaft back to the drive shaft. An outer propeller shaft supports a second propeller adjacent a trailing and thereof, and the outer propeller shaft surrounds the inner propeller shaft. A differential gear set receives a second portion of the torque and supplies the second portion to the outer propeller shaft so that the second propeller rotates in an opposite rotational direction to the first propeller. The thrust, generated by the first and the second propellers, is conveyed along either the inner or the outer propeller shafts, to the drive shaft.

20 Claims, 9 Drawing Sheets

MARINE PROPULSION SYSTEM SUPPORTED BY A STRUT

FIELD OF THE INVENTION

The present invention relates generally to a marine propulsion system and, in particular, to a marine propulsion system comprising a differential gear set mounted in the strut to facilitate driving a second propeller in an opposite rotational direction. The thrust, generated by the first and second counter rotating propellers, is transferred back along the inner and outer propeller shafts, respectively, and the drive shaft to the transmission and the engine for distribution to the vessel. In addition, the marine propulsion system includes a completely closed lubrication system, for lubricating all of the rotatable components thereof as well as a shimming system to alter the orientation/position of the strut and inner and outer propeller shafts, relative to the drive shaft, to compensate for any misalignment therebetween.

BACKGROUND OF THE INVENTION

Counter rotating propellers are highly desirable for some marine applications. Normally counter rotating propellers are utilized for outdrives, pod systems and outboard motors. Dual propellers, that are counter-rotating, provide a much improved level of thrust efficiency, as well as allowing the thrust path to be straight when moving forward or astern. In addition, the dual propellers remove a paddle wheel effect of a single propeller that typically forces the stern of the vessel in the direction of rotation, also known as side thrust.

What is lacking in the prior art is a strut mounted propulsion system having counter rotating propellers in which the thrust, generated by the counter rotating propellers, is transferred from the propellers along the propeller shafts and the drive shaft and back to the transmission and/or the engine for dissipation and distribution.

SUMMARY OF THE INVENTION

Wherefore, it is an object of the present invention to overcome the above mentioned shortcomings and drawbacks associated with the prior art.

Another object of the present disclosure is to provide a marine propulsion system, with a pair of counter rotating propellers, in which the torque is supplied by the drive shaft and the inner and outer propeller shafts to the first and second propellers, and thrust, generated by the first and second propellers, is conveyed back along the inner and the outer propeller shafts and the drive shaft upstream toward the transmission and the engine for dissipation and distribution, while bypassing the differential gear set.

A further object of the present disclosure is to directly couple the leading end of the outer propeller shaft to the leading end of the inner propeller shaft, so that the inner and the outer propeller shaft can rotate in opposite directions with respect to one another, during operation, while still facilitating transfer of the thrust generated by the second propeller to interface between the inner propeller shaft and the drive shaft.

Yet another object of the present disclosure is to provide one or more contoured spacer insert(s)/shim(s) for either (1) spacing the strut a desired distance away from the outwardly facing bottom surface of the hull or (2) altering the orientation/position of the inner and the outer propeller shafts and the strut, relative to either the outwardly facing bottom surface of the hull, the drive shaft, the transmission, e.g., tilt the strut forward or rearward, or toward the right or the left, or both, to assist with precisely aligning the drive shaft with the inner and outer propeller shafts so that the generated thrust, from the first and second propellers, is directed and conveyed along the inner and outer propeller shafts and the drive shaft toward the transmission and the engine for distribution and dissipation.

A still further object of the present disclosure is to form a lubricate chamber, within the marine propulsion system, which is completely sealed and isolated from the external environment by a plurality of watertight rotatable seals so that all of the rotatable components, e.g., the differential gear set, the needle bearings, tapered bearings, thrust bearings, the differential input shaft, the differential output shaft, the inner propeller shaft, the outer propeller shaft, etc., of the marine propulsion system are adequately lubricated during operation.

The counter rotating propeller system of the present disclosure is designed for use with boats using traditional or conventional straight fixed propeller shafts from relatively low to very high horse power, for both pleasure as well as commercial/military applications. These drive and propeller shafts can be angled at virtually any orientation to comply with the parameters of the vessel design, and the design is fully scalable to meet any power requirements.

Another advantage achieved by the counter rotation at the propeller end makes the shaft design inside the boat relatively simple. The present design does not require a special transmission with any counter rotating mechanism(s). Another advantage is that maintenance is simpler and more effective to complete. The present design allows the complete marine propulsion system to be removed from its gear case as a complete assembly for service, maintenance or repair, without having to remove the main shaft system or strut/gear case from the vessel The present invention relates to a marine propulsion system, supported by a strut, comprising: an inner propeller shaft supporting a first propeller adjacent a trailing end thereof, and the inner propeller shaft having an interface, at a leading end thereof, to facilitate connection with a drive shaft for receiving torque supplied thereto and for supplying a first portion of the torque to the first propeller; an outer propeller shaft supporting a second propeller adjacent a trailing and thereof, and the outer propeller shaft surrounding at least a portion of the inner propeller shaft; and a differential gear set for receiving a second portion of the torque from the drive shaft and supplying the second portion of torque to the outer propeller shaft so that the second propeller rotates in an opposite direction to the first propeller; wherein thrust, generated by rotation of the first and the second propellers, is conveyed back along either the inner propeller shaft or the outer propeller shaft and back to the drive shaft while the thrust, conveyed upstream to the drive shaft, avoids from passing through either the differential gear set or the strut.

The present invention relates to marine propulsion system comprising: a strut having a strut through bore extending through; an inner propeller shaft supporting a first propeller adjacent a trailing end thereof, and the inner propeller shaft having an interface, at a leading end thereof, to facilitate connection with a drive shaft for receiving torque therefrom and supplying a first portion of the torque to the first propeller as well as for transferring thrust, generated by the first propeller, along the inner propeller shaft back to the drive shaft; an outer propeller shaft supporting a second propeller adjacent a trailing end thereof, and the outer propeller shaft surrounding a portion of the inner propeller shaft; the inner and the outer propeller shafts both extending through the strut through bore; a differential gear set being accommodated within the strut and surrounding both the outer and inner propeller shafts, the differential gear set comprising a differential input shaft, a differential output shaft and first and second idle gears, and the differential input shaft being drivingly connected to the inner propeller shaft in order to receive a second portion of the torque supplied thereto and the differential gear set reversing the second portion of the torque so that the differential output shaft drives the outer propeller shaft so as to rotate the second propeller in an opposite rotational direction than the first propeller; and a leading end of the outer propeller shaft being connected to a leading end of the inner propeller shaft to facilitate, during operation, both rotation of the outer propeller shaft with respect to the inner propeller shaft as well as transfer of thrust, generated by the second propeller, to the inner propeller shaft and back to the drive shaft.

The present invention also relates to a method of using a marine propulsion system to power a vessel, the method comprising: providing a strut having a strut through bore extending through; supporting a first propeller adjacent a trailing end of an inner propeller shaft, and forming an interface, adjacent a leading end of the inner propeller shaft, to facilitate connection with a drive shaft and receive torque therefrom, and the inner propeller shaft supplying a first portion of the torque to the first propeller as well as transferring thrust, generated by the first propeller, along the inner propeller shaft back to the drive shaft; supporting a second propeller adjacent a trailing end of an outer propeller shaft, and surrounding the inner propeller shaft with the outer propeller shaft; extending both the inner and the outer propeller shafts through the strut through bore; accommodating a differential gear set within the strut and at least partially surrounding the outer propeller shaft with the differential gear set, the differential gear set comprising a differential input shaft, a differential output shaft and a pair idle gears; drivingly connecting the differential input shaft to the inner propeller shaft in order to receive a second portion of the torque supplied thereto and drivingly connecting the differential output shaft to the outer propeller shaft with the differential gear set causing the second propeller to rotate in an opposite rotational direction than the first propeller; and connecting a leading end of the outer propeller shaft to a leading end of the inner propeller shaft to facilitate, during operation, both rotation of the outer propeller shaft with respect to the inner propeller shaft as well as transfer of thrust, generated by the second propeller, to the inner propeller shaft and back to the drive shaft

BRIEF DESCRIPTION OF THE DRAWINGS

The accompanying drawings, which are incorporated in and constitute a part of the specification, illustrate an embodiment of the invention and together with the general description of the invention given above and the detailed description of the drawings given below, serve to explain the principles of the disclosure. The invention will now be described, by way of example, with reference to the accompanying drawings in which.

Figure 1:
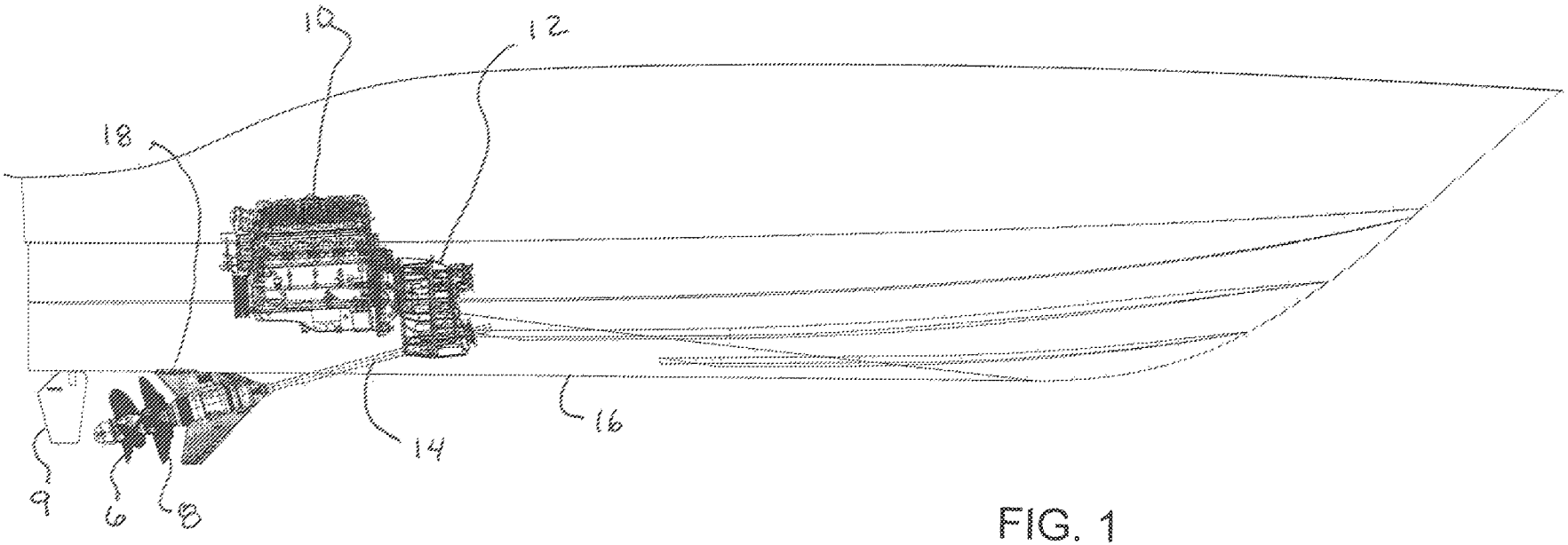
FIG. 1 is a diagrammatic side partial cross sectional view showing the marine propulsion system installed with a vessel and driven by an engine and a transmission.

It should be understood that the drawings are not necessarily to scale and that the disclosed embodiments are sometimes illustrated diagrammatical and in partial views. In certain instances, details which are not necessary for an understanding of this disclosure or which render other details difficult to perceive may have been omitted. It should be understood, of course, that this disclosure is not limited to the particular embodiment illustrated herein.

DETAILED DESCRIPTION OF THE PREFERRED EMBODIMENTS

The present invention will be understood by reference to the following detailed description, which should be read in conjunction with the appended drawings. It is to be appreciated that the following detailed description of one embodiment is by way of example only and is not meant to limit, in any way, the scope of the present invention.

In the drawings, the terms "upstream" and "leading end" refer toward the left of the respective drawing, i.e., in a direction to toward the engine and the transmission from where the torque is generated, while the terms "downstream" and "trailing end" refer toward the right in the respective drawing away from the transmission and the engine. Also in the drawings, the terms "lower" and "bottom" refer toward the bottom of the respective drawing while the terms "upper" and "top" refer toward the top of the respective drawing.

Turning now to FIGS. 1-3C, a brief description concerning the various components of the present disclosure will now be briefly discussed. As can be seen in this embodiment, the present invention relates to a marine propulsion system 2 which is supported by a strut 4 and has first and second counter rotating propellers 6, 8.

As is diagrammatically shown in FIG. 1, the marine propulsion system 2 is driven or powered by a conventional engine 10, such as an internal combustion (e.g., gas or diesel) engine (only diagrammatically shown). The output from the crankshaft of the engine 10 is typically drivingly coupled to a reducing transmission 12 (only diagrammatically shown) while the output from the reducing transmission 12 drives a leading end of a drive shaft 14 which forms the input to the marine propulsion system 2. A drive coupling member 15 connects the reducing transmission 12 to the drive shaft 14. A rudder 9 is installed, behind the first and the second counter rotating propellers 6, 8, to facilitate steering of the vessel in a conventional manner.

As is typically in the art, during installation of the marine propulsion system 2 with a vessel, the drive shaft 14 passes through a hull aperture, formed in the bottom surface of the hull 16 of the vessel, and the section of the drive shaft 14, which passes through the hull aperture, is sealed, in a conventional watertight manner (not shown), with respect to the bottom surface of the hull 16 of the vessel. As the such watertight connection between the hull aperture, in the hull 16 of the vessel, and the drive shaft 14 is conventional and well known in the art, a further detail discussion concerning the same is not provided.

Figure 2A:
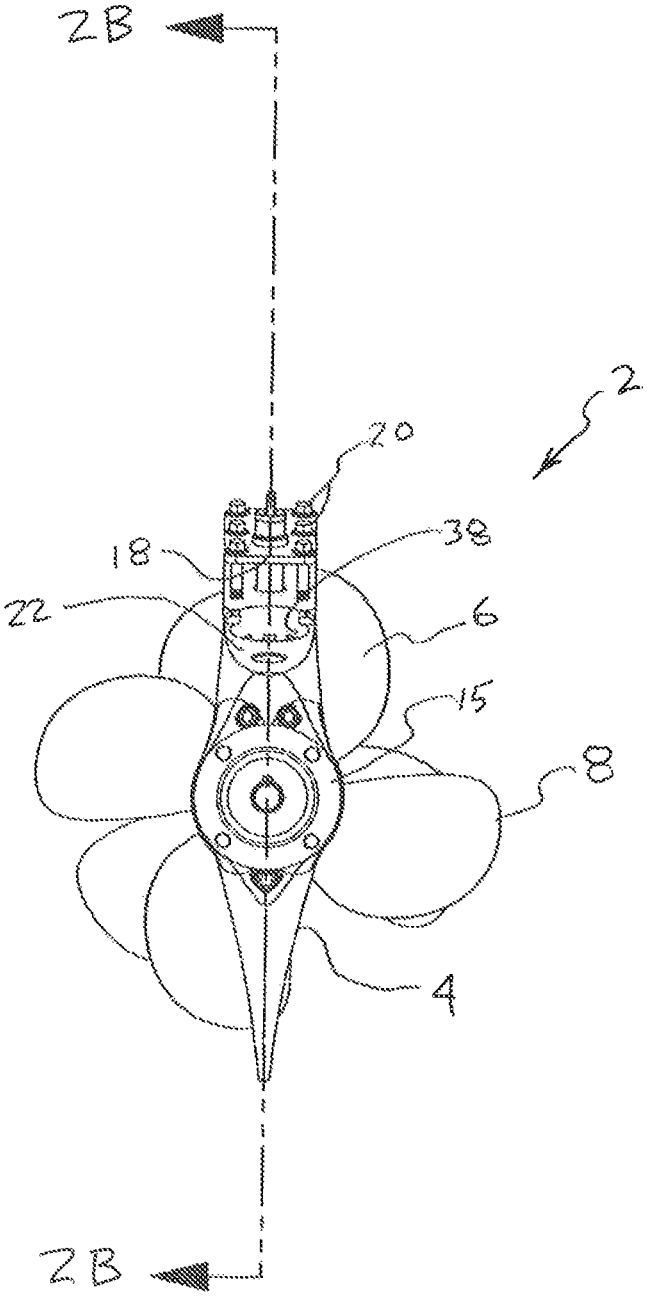
FIG. 2A is a diagrammatic leading end view of the marine propulsion system according to the disclosure.
Figure 2B:
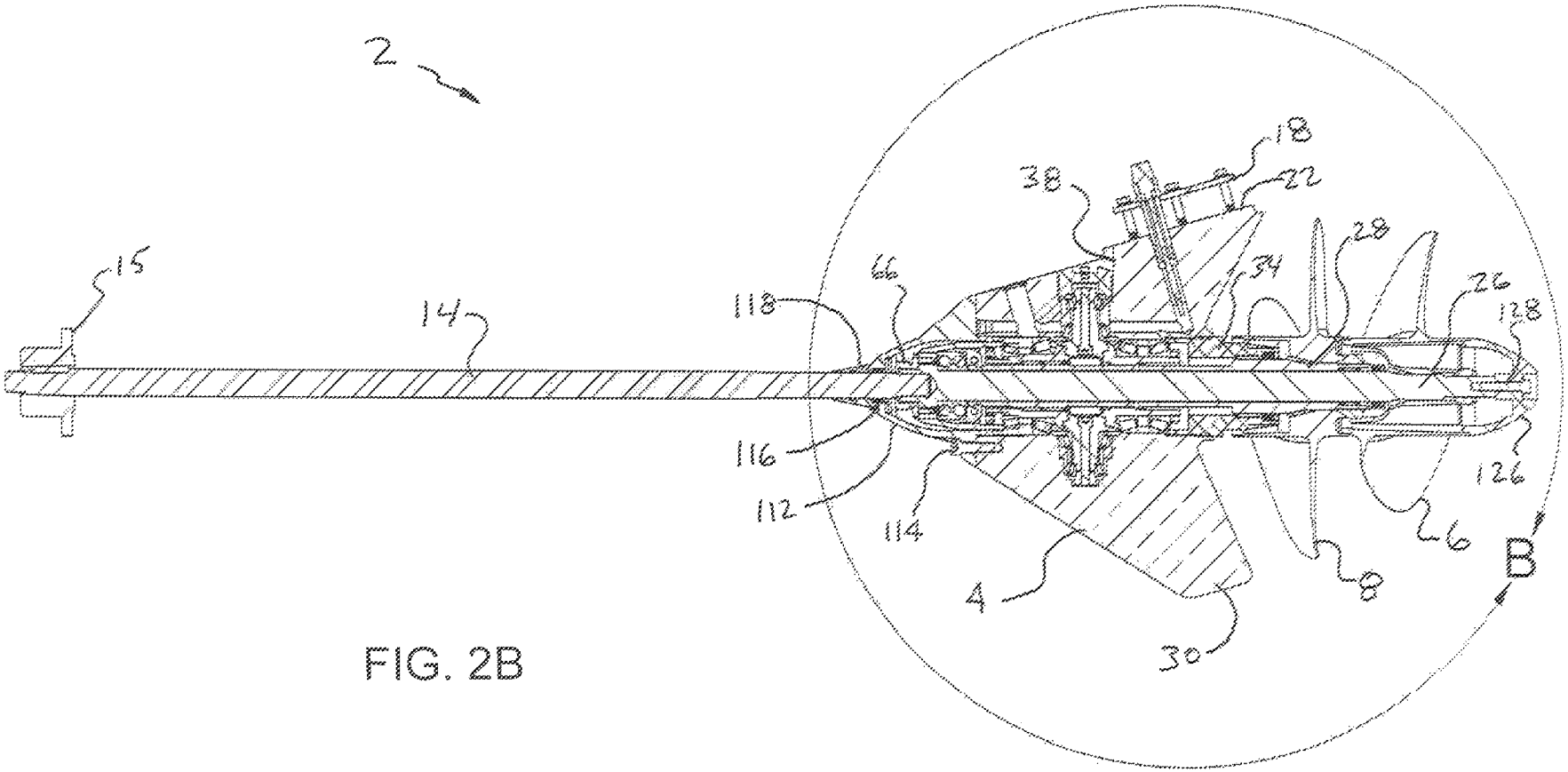
FIG. 2B is a diagrammatic side cross sectional view of the marine propulsion system along section line 2B-2B of FIG. 2A.

A strut 4 is fixedly secured, in a conventional manner, to a bottom surface of the hull 16 of the vessel by a mounting plate 18 and a plurality of fasteners 20, e.g., a plurality of bolts, six of which are shown in FIG. 2A. Following installation of the strut 4, the mounting plate 18 is located within and abuts against an inwardly facing bottom surface of the hull 16 of the vessel while a flat end face 22, located adjacent a top section of the strut 4, abuts against an outwardly facing bottom surface of the hull 16. The plurality of fasteners 20 each pass through a respective through bore, formed in the mounting plate 18, and are then threadedly received by a respective mating threaded bore (not shown in detail), formed within the flat end face 22 of the strut 4, to assist with securely fastening the strut 4 to the bottom surface of the hull 16. Typically, at least a perimeter region of the bottom surface of the hull 16 is directly sandwiched between the mounting plate 18 and the flat end face 22 of the strut 4 in a conventional water tight manner to prevent water from passing therebetween.

Figure 4A:
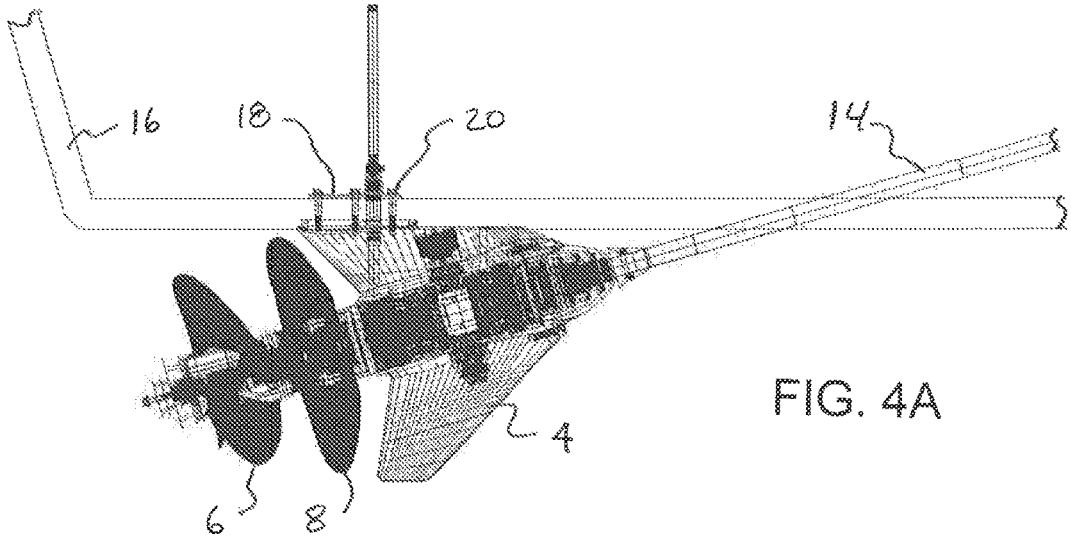
FIG. 4A is a diagrammatic side cross sectional view of the marine propulsion system of FIG. 2B showing a spacer insert/shim located between the mounting plate and an end face of the strut for spacing the strut further distance away from the hull of the vessel.

If desired or required, one or more contoured spacer insert(s)/shim(s) 24 may be located between the outwardly facing bottom surface of the hull 16 and the flat end face 22 of the strut 4. One or more contoured spacer insert(s)/shim(s) 24 may be used to either space the flat end face 22 of the strut 4 a further distance away from the outwardly facing bottom surface of the hull 16 (see FIG. 4A) or possibly to alter or change the orientation/position of the strut 4, relative to either the outwardly facing bottom surface of the hull 16 or the drive shaft 14 and/or transmission 12, e.g., tilt the strut 4 a little more forward (see FIG. 4B) or tilt the strut 4 a little more rearward (see FIG. 4C) or possible tilt the strut 4 either toward the right or the left of the vessel (not shown). Each one of the contoured spacer insert(s)/shim(s) 24 is provided with either a central opening or respective through bores for allowing each one of the fasteners 20 to pass therethrough and engage with the strut 4.

By installation of one or more suitably shaped and sized contoured spacer insert(s)/shim(s) 24, between the outwardly facing bottom surface of the hull 16 and the flat end face 22 of the strut 4, the orientation/position of the strut 4 as well as the inner and outer shafts 26, 28 relative to the drive shaft 14, the bottom surface of the hull 16 and/or the transmission 12 can be readily, but securely, altered. The use of one or more contoured spacer insert(s)/shim(s) 24 is helpful with precisely aligning the drive shaft 14 with the inner and outer propeller shafts 26, 28 so that the generated thrust, from the first and second propellers 6, 8, is conveyed and transferred back along the inner and outer propeller shafts 26, 28 and the drive shaft 14 toward at least the transmission 12 for distribution and dissipation throughout the vessel.

Figure 4B:
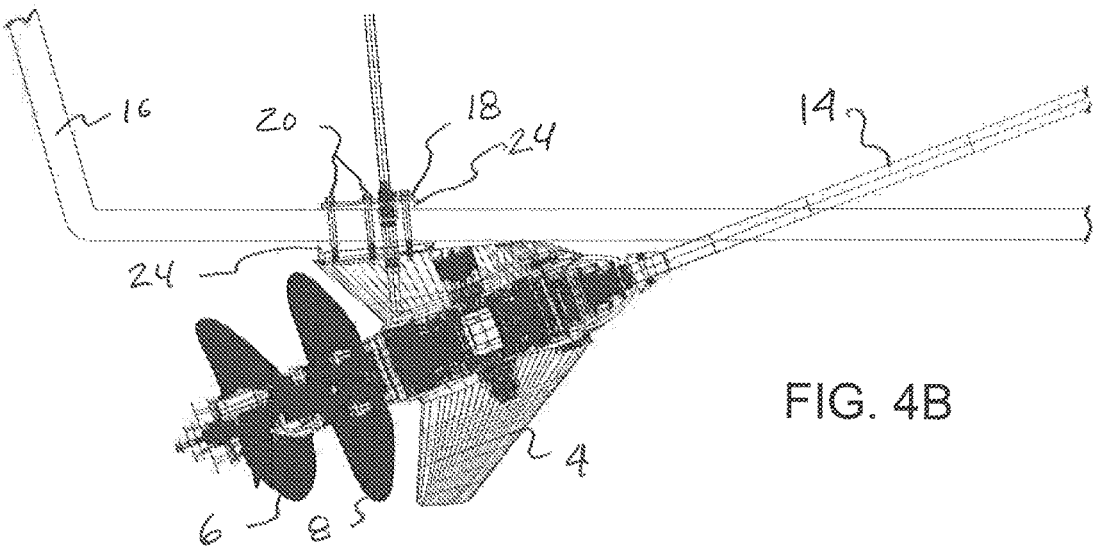
FIG. 4B is a diagrammatic side cross sectional view of the marine propulsion system of FIG. 2B showing a spacer insert/shim located between the mounting plate and the flat end face of the strut for tilting the strut slightly forward.
Figure 4C:
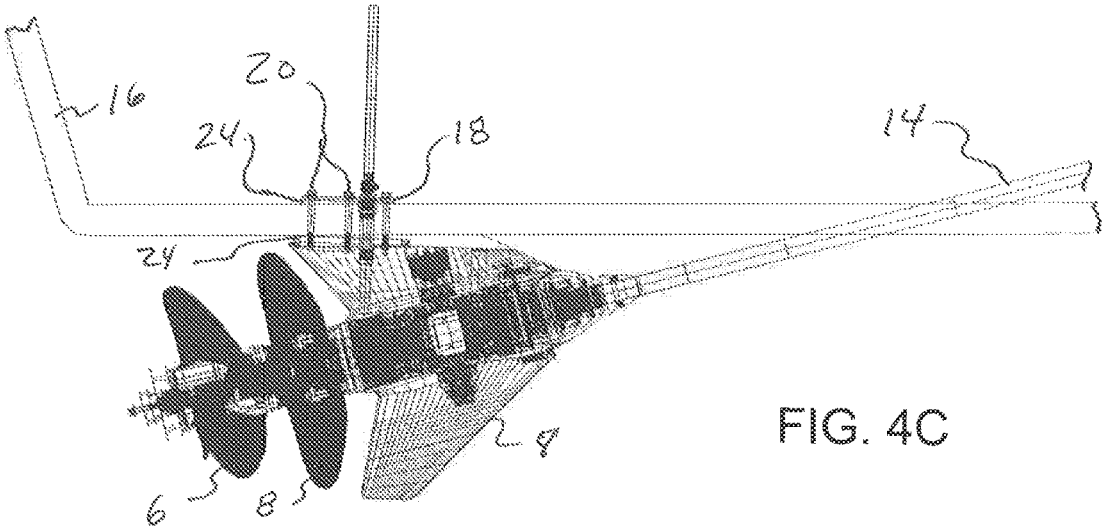
FIG. 4C is a diagrammatic side cross sectional view of the marine propulsion system of FIG. 2B showing a spacer insert/shim located between the mounting plate and the flat end face of the strut for tilting the strut slightly rearward.

As shown in FIGS. 4B and 4C, if a first tapered contoured spacer insert(s)/shim(s) 24 is located between the outwardly facing bottom surface of the hull 16 and the flat end face 22 of the strut 4, a second similar, but oppositely arranged, tapered contoured spacer insert(s)/shim(s) 24 is also typically located between the bottom surface of the mounting plate 18 and the inwardly facing bottom surface of the hull 16 so that the flat end face 22 of the strut 4 and the bottom surface of the mounting plate 18 still remain substantially parallel to one another follow installation. It is to be appreciated that, depending upon the thickness of the tapered contoured spacer inserts/shims 24 utilized, longer fasteners 20 may be required to connect the mounting plate 18 to the strut 4.

Figure 2C:
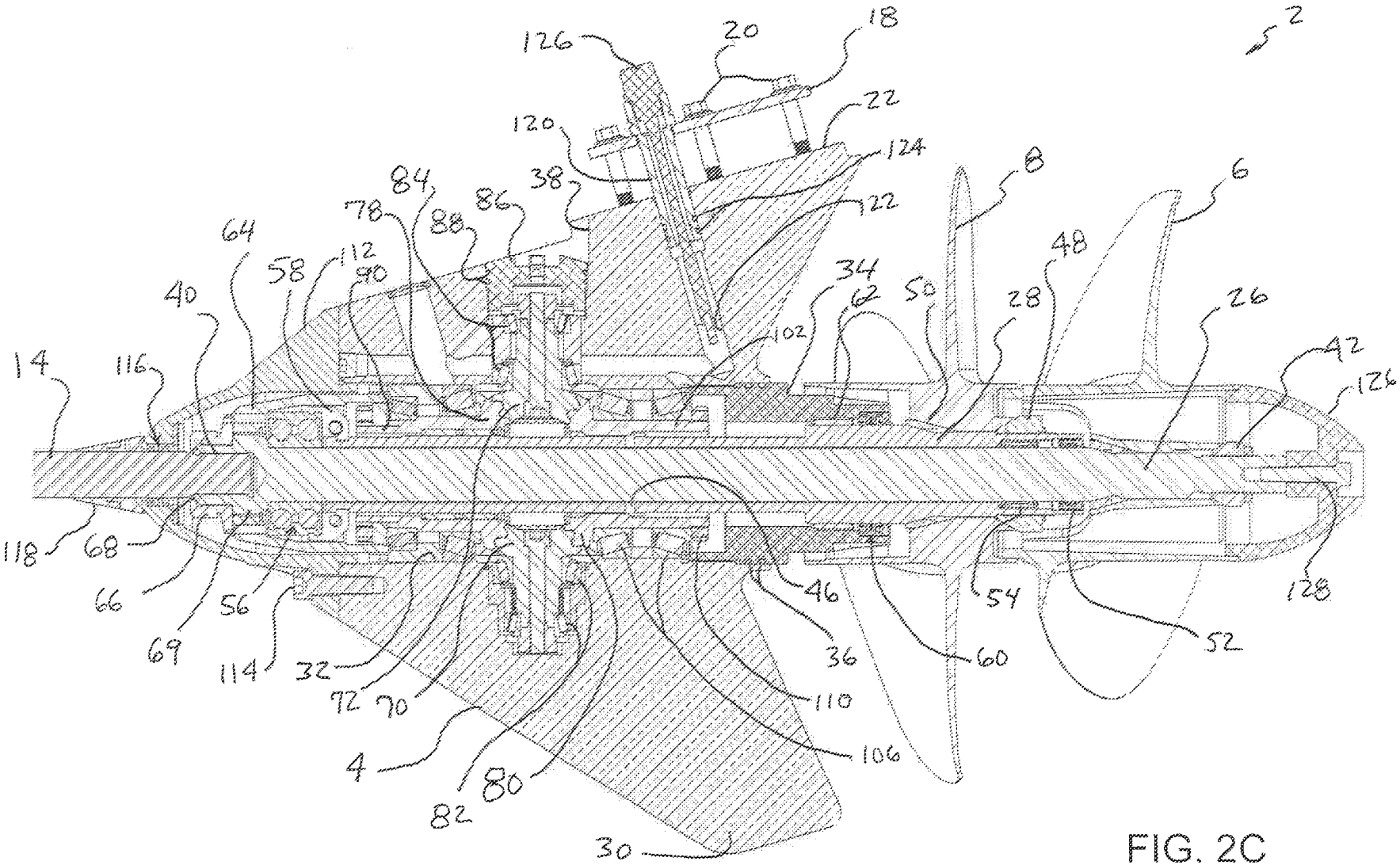
FIG. 2C is an enlarged diagrammatic cross sectional view of circled area B of FIG. 2B.
Figure 5:
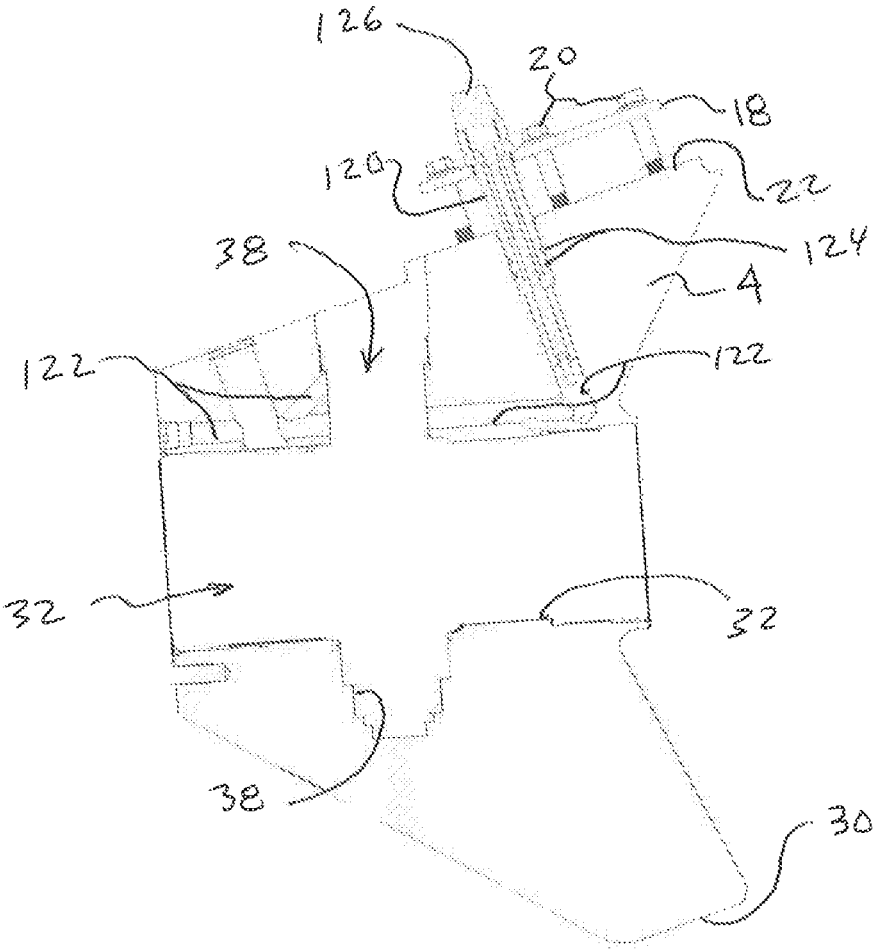
FIG. 5 is a diagrammatic cross sectional view of the strut, shown in FIGS. 2B and 2C, prior to assembly of a remainder of the marine propulsion system components therewith.

As shown in FIGS. 2C and 5, a skeg 30 is located at opposite the flat end face 22 and forms a bottom portion of the strut 4. A strut through bore 32 extends completely through a central region of the strut 4, from a leading end to a trailing end thereof, and located between the flat end face 22 and the skeg 30. The strut through bore 32 is shaped and sized so as to closely receive and accommodate therein the rotatable drive components of the marine propulsion system 2, which are described below in further detail. A trailing end of the strut through bore 32 carries an internal thread (not separately labeled) while a leading end of a bearing carrier or a through bore extension 34 carries an external thread (not separately labeled). The thread of the through bore extension 34 threadedly engages with the internal thread of the strut through bore 32 to connect the through bore extension 34 while also facilitate assembly and servicing of the marine propulsion system 2. An exterior surface of the through bore extension 34 carries a pair of spaced apart O-rings 36 which are respectively received within a pair of spaced apart O-ring recesses (not separately labeled), and, following assembly, the O-rings 36 sealingly engage with an inwardly facing surface of the strut through bore 32 to form a watertight seal therebetween and prevent water from flowing past the through bore extension 34 and the inwardly facing surface of the strut 4.

The strut 4 also includes a strut blind bore 38 which extends from a top surface of the strut 4, adjacent the flat end face 22, toward the skeg 30. The strut blind bore 38 intersects with and passes through the strut through bore 32. As shown, the strut blind bore 38 continues a short distance, below and past the strut through bore 32, before eventually terminating prior to reaching an end portion of the skeg 30. The strut blind bore 38 is sized and shaped to accommodate a differential gear set, and a further discussion concerning the purpose and function of the differential gear set will be provided below.

Figure 3A:
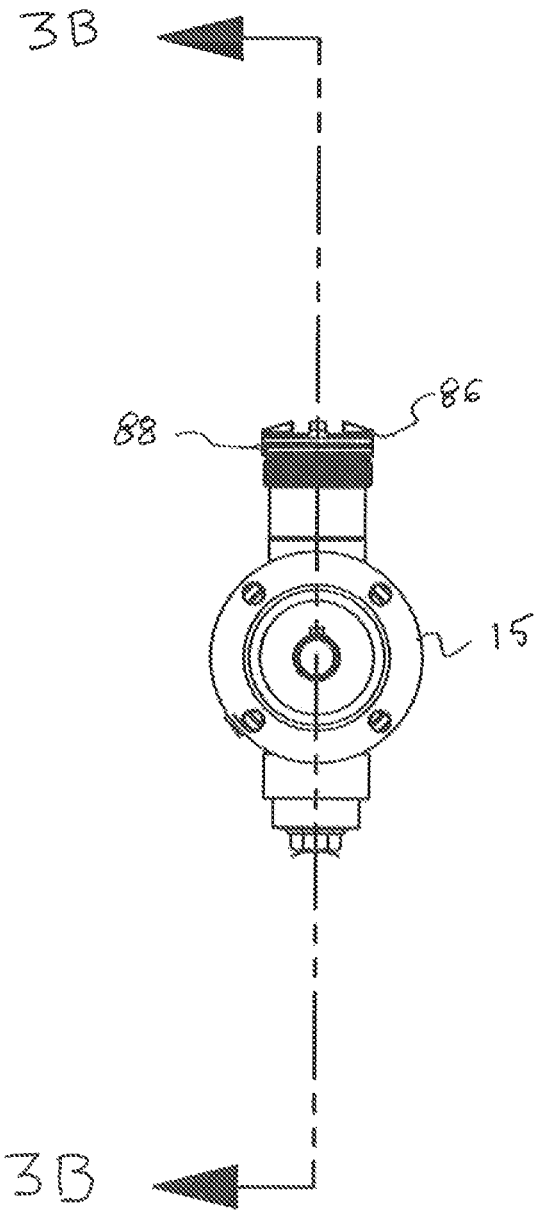
FIG. 3A is a diagrammatic leading end view of the marine propulsion system components, prior to assembly of the same within the strut and attachment of the first and second propellers thereto.
Figure 3B:
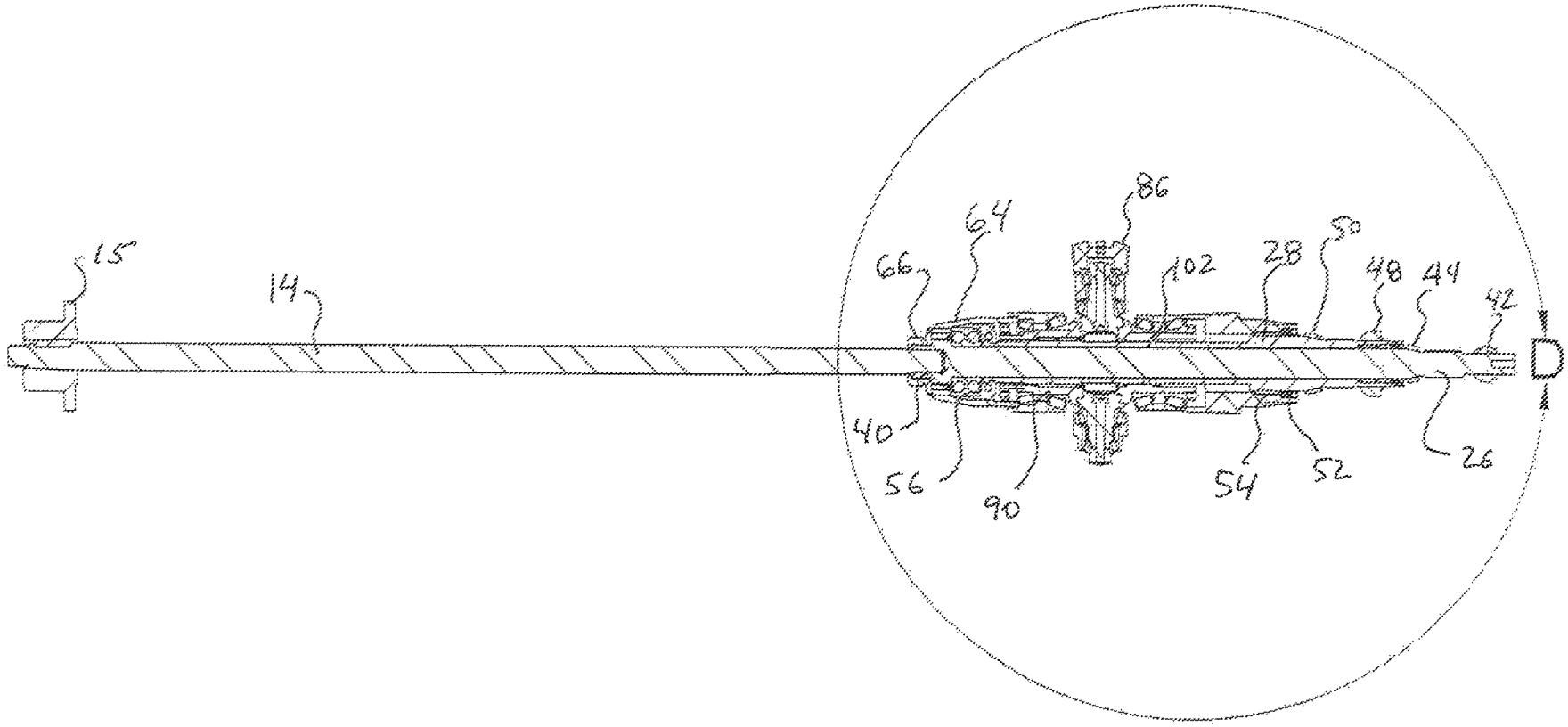
FIG. 3B is a diagrammatic cross sectional view of the marine propulsion system components along section line 3B-3B of FIG. 3A.
Figure 3C:
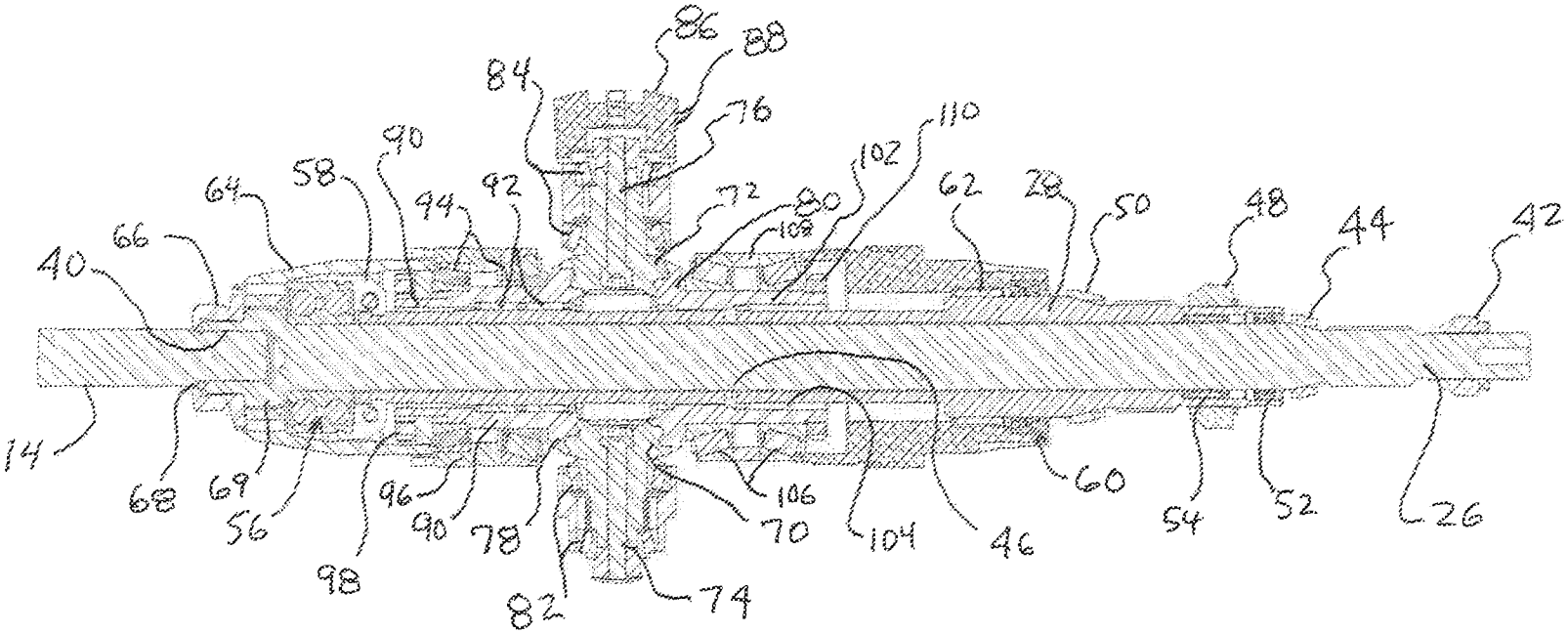
FIG. 3C is an enlarged diagrammatic cross sectional view of circled area D of FIG. 3B.

As diagrammatically shown in FIGS. 2C and 3C of the drawings, the trailing end of the drive shaft 14 is provided with an external spline while the leading end of the inner propeller shaft 26 has in inwardly facing spline. The spline of the drive shaft 14 matingly engages with the spline of the inner propeller shaft 26 to form an interface or a spline connection (i.e., a coupling feature) 40 which pivotably couples those two shafts with one another. The spline connection 40 permits the drive shaft 14 to pivot, over a relatively small range of movement, with respect to the inner propeller shaft 26, and vice versa, in order to compensate for any misalignment between the drive shaft 14 and the inner propeller shaft 26 with respect to one another. That is, while it is preferable that the drive shaft 14 and the inner propeller shaft 26 be generally axially aligned with one another during operation of the marine propulsion system 2, the mating spline connection 40 permits a small amount of deviation between the drive shaft 14 relative to the inner propeller shaft 26, and vice versa, without compromising the transfer of torque or the transfer of thrust between those two coupled shafts.

Immediately downstream of the mating spline connection 40, between the trailing end of the drive shaft 14 and the leading end of the inner propeller shaft 26, the driving power or torque from the drive shaft 14, supplied by the transmission 12 and the engine 10, is split into a first portion of torque and a second portion of torque. As discussed below in further detail, the second portion of torque will eventually, after passing through the differential gear set, have an opposite rotational direction from a first portion of torque so that the first and the second propellers 6, 8 will rotate in opposite rotational directions from one another and thereby provide a counter rotating drive for the marine propulsion system 2.

The inner propeller shaft 26 passes completely through the strut through bore 32 and extends out from the trailing end of the strut through bore 32. As shown in FIG. 2C for example, a first propeller 6 is securely, but removably, connected to a trailing end of the inner propeller shaft 26. Typically, the trailing end of the inner propeller shaft 26 has an exterior spine while an inwardly facing surface of the first propeller 6 with has a mating spline (which together form a coupling feature). Once the spline of the first propeller 6 engages with the exterior spine of the inner propeller shaft 26, a first propeller nut 42 then threadedly engages with a threaded section, formed adjacent the trailing end of the inner propeller shaft 26, to releaseably secure the first propeller 6 to the spline of the inner propeller shaft 26. The releaseably of the first propeller nut 42 also facilitate replacement of the first propeller 6 in the event the same becomes damaged, for some reason.

An inner shaft bushing 44 is located on the inner propeller shaft 26, adjacent a trailing end of the outer propeller shaft 28, to prevent over insertion of the first propeller 6 on the inner propeller shaft 26 and also transfer the thrust, generated by the first propeller 6, to the inner propeller shaft 26 and convey the same upstream toward the transmission 12 for distribution to the vessel. As diagrammatically shown, the first propeller 6 has a right handed pitch but, depending upon the rotational direction of the drive shaft 14, the first propeller 6 may also have a left handed pitch.

As can be seen in FIG. 2C, the outer propeller shaft 28 surrounds the inner propeller shaft 26 and the outer propeller shaft 28 has an axial length which is a somewhat shorter than the axial length of the inner propeller shaft 26 so that the inner propeller shaft 26 projects further away from the trailing end of the strut 4 than the outer propeller shaft 28. As also shown is FIG. 2C, the inner propeller shaft 26 also projects further away from the leading end of the strut 4 than the outer propeller shaft 28. The outer propeller shaft 28 extends at least generally along the entire axial length of the strut through bore 32 and extends out from the trailing end thereof. One or more radial lubricating port(s) 46 is/are formed within the outer propeller shaft 28, e.g., in a central section thereof, to facilitate the supply of lubricant through the outer propeller shaft 28 to the inner propeller shaft 26 to lubricate the same during operation of the marine propulsion system 2, as will be discussed below in further detail.

The second propeller 8 is securely, but removably, connected to a trailing end of the outer propeller shaft 28. Typically, the trailing end of the outer propeller shaft 28 has an exterior spine while the inwardly facing surface of the second propeller 8 with has a mating spline (which together form a coupling feature). Once the spline of the second propeller 8 engages with the exterior spine of the outer propeller shaft 28, a second propeller nut 48 threadedly engages with a threaded section, formed at the trailing end of the outer propeller shaft 28, to releaseably secure the second propeller 8 to the spline of the second propeller shaft. The releaseably of the second propeller nut 48 also facilitate replacement of the second propeller 8 in the event the same becomes damaged, for some reason.

An outer shaft bushing 50 is provided on the outer propeller shaft 28, adjacent a trailing end of the through bore extension 34, to prevent over insertion of the second propeller 8 on the outer propeller shaft 28 and also transfer the thrust, generated by the second propeller 8, to the outer propeller shaft 28 and convey such thrust upstream toward the transmission 12 for distribution to the vessel. As shown, the second propeller 8 has a left handed pitch but, depending upon the rotational direction of the drive shaft 14, may have a right handed pitch.

A conventional first rotatable fluid tight seal assembly 52 is located between the trailing end of the inner propeller shaft 26 and the trailing end of the outer propeller shaft 28 to prevent water from passing between the inner and the outer propeller shafts 26, 28. In addition, at least a first needle bearing(s) 54 is located between the trailing end of the inner propeller shaft 26 and the trailing end of the outer propeller shaft 28, adjacent to but located upstream of the first rotatable fluid tight seal assembly 52, to facilitate rotation of the inner and the outer propeller shafts 26, 28 relative to one another in opposite rotational directions.

A conventional double row ball bearing 56 is located between the leading end of the outer propeller shaft 28 and a stepped shoulder 69 form at the leading end of the inner propeller shaft 26, closely adjacent the interface. An inner race of the double row ball bearing 56 directly engages with the inner propeller shaft 26 while a thrust bearing collar 58 interconnects the outer propeller shaft 28 with an outer race of the double row ball bearing 56. The thrust bearing collar 58 is secured to the leading end of the outer propeller shaft 28 so as to maintain the leading end of the outer propeller shaft 28 both axially spaced away from the double row ball bearing 56 as well as radially spaced away from the inner propeller shaft 26, while still permitting the inner and the outer propeller shafts 26, 28 to rotate in opposite rotational directions with respect to one another.

A conventional second rotatable fluid tight seal assembly 60 is located between the outer propeller shaft 28 and the trailing end of the through bore extension 34 to prevent water from passing therebetween. In addition, at least a second needle bearing(s) 62 is located between the outer propeller shaft 28 and the trailing end of the through bore extension 34, adjacent to but upstream of the second rotatable fluid tight seal assembly 60, to facilitate rotation of the outer propeller shaft 28 relative to the through bore extension 34.

An outwardly facing exterior spline is formed in the inner propeller shaft 26, a small distance away from the leading end thereof, while an inwardly facing surface of a drive cage 64 has a mating inwardly facing internal spline (which together form a coupling feature). When the internal spline of the drive cage 64 mates with the exterior spline of the inner propeller shaft 26, the mating splines interlock those two components with one another so that the drive cage 64 becomes integral and rotates along with the inner propeller shaft 26 to transfer the second portion of torque. As shown in the drawings, an inwardly facing surface of the drive cage 64 also abuts against a leading end of the double row ball bearing 56 which forms a stop and prevents over insertion of the drive cage 64 as well as assist with transferring thrust from the double row ball bearing 56 to the inner propeller shaft 26.

The leading end of the inner propeller shaft 26 carries an exterior thread while an inwardly facing surface of a shaft nut 66 carries a mating internal thread. The trailing end of the drive shaft 14, adjacent but upstream of the spline, has an annular (e.g., arcuate) groove formed therein. A mating pair of half rings 68 are partially accommodated within this annular groove and the mating pair of half rings 68 are also partially accommodated and/or sandwiched between a chamfered surface, formed in the leading end of the inner propeller shaft 26, and an inwardly facing chamfer formed in the shaft nut 66. As a result of this arrangement, when the internal thread of the shaft nut 66 engages with the external thread of the inner propeller shaft 26, the mating pair of half rings 68 are captively by the annular groove, the chamfered surface and the inwardly facing chamfer so as to retain the spline connection 40, between the drive shaft 14 and the inner propeller shaft 26, and prevent inadvertent separation of those two shafts from one another. In addition, an end surface of the shaft nut 66 also abuts against both the drive cage 64 and the stepped shoulder 69 of the inner propeller shaft 26 to maintain the spline connection between the drive cage 64 and the inner propeller shaft 26 and prevent inadvertent separation thereof. As shown, a leading section of the drive cage 64 is sandwiched and captively retained between the shaft nut 66 and the double row ball bearing 56 and assists with convey thrust back to the drive shaft 14.

During operation of the marine propulsion system 2, the thrust, generated by the first propeller 6, is conveyed upstream along the inner propeller shaft 26, through the spline connection 40, to the drive shaft 14 and eventually to the transmission 12 and possibly the engine 10 for distribution to the vessel. In addition, the thrust, generated by the second propeller 8, is conveyed upstream along the outer propeller shaft 28 to the thrust bearing collar 58, the double row ball bearing 56, the stepped shoulder 69 of the inner propeller shaft 26, the drive cage 64, the shaft nut 66, through the spline connection 40, to the drive shaft 14 and eventually to the transmission 12 and possibly the engine 10 for distribution. As a result of this disclosed arrangement, virtually none of the generated thrust, from either the first and the second propellers 6, 8, is transferred to or passes through the differential gear set, the strut 4 or the mounting plate 18 to the vessel.

As best shown in FIG. 2C, first and second idler gears 70, 72 of the differential gear set are at least partially located within the strut blind bore 38. The first idler gear 70 is support adjacent one end of a first idler gear shaft 74 while the second idler gear 72 is support adjacent one end of a second idler gear shaft 76. Each one of the first and second idler gears 70, 72 is typically a spiral bevel gear having, for example, between 10 and 50 teeth, typically 17 teeth. As shown in the drawings, a closed bottom of the strut blind bore 38 receives and accommodates the first idler gear shaft 74 while the first idler gear 70 is at least partially accommodated within the strut through bore 32. The open end of the strut blind bore 38 receives and accommodates the second idler gear shaft 76 while the second idler gear 72 is at least partially accommodated within the strut through bore 32.

As shown, both the first and the second idler gear shafts 74, 76 are primarily located within the strut blind bore 38 and axially aligned with one another such that the first and second idler gears 70, 72 can engage with a differential input gear 78 and a differential output gear 80, as discussed below in further detail. A first pair of tapered roller bearings 82 supports the first idler gear shaft 74 within the strut blind bore 38 to facilitate rotation of the first idler gear 70 with respect to the strut 4 while a second pair of tapered roller bearings 84 supports the second idler gear shaft 76 within the strut blind bore 38 to facilitate rotation of the second idler gear 72 with respect to the strut 4.

A leading end of a blind bore plug 86 carries an external thread which engages with an internal thread formed within and adjacent the open end of the strut blind bore 38. An exterior surface of the blind bore plug 86 also carries a pair of spaced apart O-rings 88, which are respectively received within a pair of spaced apart O-ring recesses (not separately labeled), and the O-rings 88 sealingly engage with an inwardly facing surface of the strut blind bore 38 to form a watertight seal therebetween and prevent water from flowing past the blind bore plug 86 into the strut blind bore 38. However, when the blind bore plug 86 is removed, access is provided to strut blind bore 38 as well as the components of the differential gear set.

A trailing end of the drive cage 64 has one or more teeth (not separately labeled), e.g., typically between 2 and 32 teeth typically about four teeth, or some other conventional interlocking/coupling feature which is/are arranged to engage with mating teeth or some other mating interlocking/coupling feature carried by a drive plate 100 coupled the drive cage 64 to a leading end of a differential input shaft 90. A trailing end of the differential input shaft 90 carries the input gear 78, e.g., a spiral bevel gear having, for example, between 10 and 50 teeth (typically 17 teeth), which matingly engages with the first and the second idlers gears 70, 72. At least third and fourth second needle bearings 92 are located between the outer propeller shaft 28 and the differential input shaft 90 to facilitate relative rotation of those two shafts with respect to one another. In addition, a pair of input tapered roller bearings 94 are provided between the strut 4 and the differential input shaft 90 to facilitate relative rotation between those components.

An input spacer 96 is located between and separates the pair of input tapered roller bearings 94 from one another. A leading exterior surface of the input spacer 96 carries an external thread which matingly engages with an internal thread formed adjacent a leading end of the strut through bore 32 to secure the input spacer 96 to the strut 4. Both the drive cage 64 and the input spacer 96 assist with maintaining the pair of input tapered roller bearings 94 in position during operation.

A leading end of the differential input shaft 90 carries an exterior thread while an input shaft bearing nut 98 carries a mating internal thread. The drive plate 100 is sandwiched between the differential input shaft 90 and the input shaft bearing nut 98. During assembly, the input shaft bearing nut 98 threadedly engages with the differential input shaft 90 to the retain pair of input tapered roller bearings 94 and maintain engagement of the input gear 78 with the first and second idlers gears 70, 72.

A leading end of a differential output shaft 102 carries an output gear 80, e.g., a spiral bevel gear having, for example, between 10 and 50 teeth (typically 17 teeth), which also matingly engages with the first and second idlers gears 70, 72. An inwardly facing surface of an intermediate/trailing section of the differential output shaft 102 carries an inwardly facing spline while an outwardly facing surface of the outer propeller shaft 28 carries a mating spline, which together form a coupling feature or torque transfer spline 104. When the spline of the differential output shaft 102 mates with the spline of the outer propeller shaft 28, the torque received by the output gear 80 and the differential output shaft 102 is transferred to the outer propeller shaft 28 and onto the second propeller 8. A pair of output tapered roller bearings 106 is provided between the strut 4 and the differential output shaft 102 to facilitate relative rotation between those components.

An output spacer 108 is located between and separates the pair of output tapered roller bearings 106 from one another. The output spacer 108 maintains the desired spacing or separation between the pair of output tapered roller bearings 106.

A trailing end of the differential output shaft 102 has an exterior thread while an output shaft bearing nut 110 carries a mating internal thread. During assembly, the output shaft bearing nut 110 threadedly engages with the differential output shaft 102 to retain the pair of output tapered roller bearings 106 and maintain engagement of the output gear 80 with the first and second idlers gears 70, 72.

In view of the above arrangement, the drive shaft 14, the inner propeller shaft 26, the drive cage 64 and the differential input shaft 90 and the input gear 78 are all driven in a first rotational direction. The second portion of torque, transferred by the input gear 78, drives the first and second idler gears 70, 72. The first and second idler gears 70, 72, in turn, drive the output gear 80 of the differential output shaft 102 in an opposite rotational direction to the differential input shaft 90. As a result of the second portion of torque passing through the differential gear set, the rotational torque of the differential output shaft 102 is reversed from that of the differential input shaft 90, i.e., they rotate in opposite rotational directions to one another. This second portion of torque is then conveyed to the outer propeller shaft 28 and the second propeller 8 which rotate in an opposite direction from the drive shaft 14, the inner propeller shaft 26, the first propeller 6 and the differential input shaft 90.

A nose cone 112 (see FIGS. 2B and 2C) covers the interface or spline connection 40 between the drive shaft 14 and the inner propeller shaft 26 as well as covers the couple of the inner propeller shaft 26 to the drive cage 64. As shown, the nose cone 112 is bolted to the leading end of the strut 4 by one or more conventional fasteners 114, e.g., one or more bolts (not separately labeled). Typically, a water tight gasket or seal (not separately labeled) is located between the nose cone 112 and the strut 4 to form a water tight seal therebetween. As shown, the nose cone 112 surrounds and covers the spline connection 40 between the drive shaft 14 and the inner propeller shaft 26, the shaft nut 66 and the drive cage 64. A conventional third rotatable fluid tight seal assembly 116 is located between the trailing end of the drive shaft 14 and a leading end of the nose cone 112 to prevent water from passing therebetween. In addition, a deflector 118 is attached to the drive shaft 14, immediately upstream but adjacent the nose cone 112 for deflecting water away from the third rotatable fluid tight seal assembly 116. The deflector 118 rotates along with the drive shaft 14 and deflects water away from the nose cone 112, as the marine propulsion system 2 is propelled through the water, during operation, and further assists with preventing water from flowing between the drive shaft 14 and the leading end of the nose cone 112. In particular, the deflector 118 minimizes the water pressure that the third rotatable fluid tight seal assembly 116 will experience during operation of the marine propulsion system 2.

In order to facilitate lubrication of all of the various bearings, e.g., the differential gear set, the needle bearings, tapered bearings, thrust bearing, the differential gear set, etc., the marine propulsion system 2 is provided with a closed lubrication system 2. As shown if FIG. 2C, the mounting plate 18 includes a filling inlet which has a cylindrical sleeve 120 formed integrally therewith, e.g., the sleeve 120 has an exterior thread while an opening formed in the mounting plate 18 has a mating interior thread. During installation of the marine propulsion system 2 with a vessel, the sleeve 120 interconnects the mounting plate 18 with a lubricant passage 122 formed in the strut 4. The exterior surface of a lower end of the sleeve 120 has a pair of spaced apart O-rings 124 which are respectively received within a pair of spaced apart O-ring recesses (not separately labeled) for forming a fluid tight seal between the sleeve 120 and the lubricant passage 122. A dip stick 126 is received within the filling inlet and normally closes and seals the lubricant filling inlet. As is conventional in the art, the dip stick 126 functions as a lubricant fluid level/sight indicator for indicating to an operator, or service personnel, when the current level of the lubricant, contained within the lubricant system, is in need of replenishment, replacement or servicing.

The lubricant passage 122 initially extends from the flat end face 22 toward the strut through bore 32. Prior to reaching the strut through bore 32, the lubricant passage 122 then turns and extends parallel to the strut through bore 32 and toward the strut blind bore 38. The lubricant passage 122 intersects with and passes through the strut blind bore 38 and extends to the leading end of the strut 4. The lubricant passage 122 is designed to supply lubricant to the various rotating components, e.g., the differential gear set, the needle bearings 54, 62, 92, the tapered bearings 82, 84, 94, 106, the thrust bearing 56, the differential input shaft 90, the differential output shaft 102, the inner propeller shaft 26, the outer propeller shaft 28, etc., during operation of the marine propulsion system 2. Typically, the fluid level of the lubricant, contained within the lubrication system, is sufficient to completely immerse all of the rotatable components of the marine propulsion system 2 within lubricant so they are sufficiently lubricated during operation.

As noted above, a watertight seal 116, 88, 36, 60, 52 is formed between the drive shaft 14 and the nose cone 112, between the nose cone 112 and the strut 4, between the strut blind bore 38 and the blind bore plug 86, between the strut through bore 32 and the through bore extension 34, between the through bore extension 34 and the outer propeller shaft 28, between the outer propeller shaft 28 and the inner propeller shaft 26, and between one or more lubricant plugs and the lubricant passage 122 to prevent any water from flowing toward the rotating components accommodated within the strut through bore 32. Such watertight rotatable seals cooperate with one another to define a lubricate chamber which is completely sealed and isolated from the external water environment.

As shown in FIG. 2C, a tail piece 126 engages with both the trailing end of the inner shaft 26 and the trailing end of the first propeller 6 so as to be connected and rotate therewith. The trailing end face of the inner shaft 26 has a threaded bore (not separately labeled) and while a central region of the tail piece 126 has a through bore (not separately labeled). A threaded fastener 128 passes through the through bore in the tail piece 126 and threadedly engages with threaded bore of the inner shaft 26 to connect the tail piece 126 to the trailing end of the inner shaft 26.

While the various drive connections have been described as generally being mating spline connections, it is to be appreciated that any other conventional connection mechanism or coupling feature may instead be utilized for transferring torque and/or thrust, from one shaft/component to another shaft/component, without the departing from the spirit and scope of the present invention.

It is apparent that various modifications and alterations of the disclosed embodiment(s) will occur to and be readily apparent to those skilled in the art. However, it is to be expressly understood that all such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description is not intended to be exhaustive or to limit the present disclosure to the precise form disclosed. Many modifications and variations are possible in light of this disclosure. It is intended that the scope of the present disclosure not be limited by the detailed description, but rather by the claims appended hereto.

It will be understood that various modifications may be made without departing from the scope of the disclosure. Although operations are depicted in the drawings a particular order, this should not be understood as requiring that such operations be performed in the particular shown order or in sequential order, or that all illustrated operations be performed, to achieve desirable results.

Wherefore, we claim:

1. A marine propulsion system, supported by a strut, comprising:

an inner propeller shaft supporting a first propeller adjacent a trailing end thereof, and the inner propeller shaft having an interface, at a leading end thereof, to facilitate connection with a drive shaft for receiving torque supplied thereto and for supplying a first portion of the torque to the first propeller;

an outer propeller shaft defining an axis and supporting a second propeller adjacent a trailing end thereof, and the outer propeller shaft surrounding at least a portion of the inner propeller shaft; and a differential gear set is axially arranged between a leading end of the outer propeller shaft and the trailing end of the outer propeller shaft, the differential gear set receiving a second portion of the torque from the drive shaft and supplying the second portion of torque to the outer propeller shaft so that the second propeller rotates in an opposite direction to the first propeller;

wherein thrust, generated by rotation of the first and the second propellers, is conveyed back along either the inner propeller shaft or the outer propeller shaft and back to the drive shaft while the thrust, conveyed upstream to the drive shaft, avoids from passing through either the differential gear set or the strut.

2. The marine propulsion system according to claim 1, wherein the marine propulsion system is incorporated into a vessel which includes a transmission and an engine, the engine is drivingly connected to the transmission, and the transmission is drivingly connected to a leading end of the drive shaft to transfer torque thereto, and a rudder is located behind the first and the second propellers to facilitate steering of the vessel by an operator.

3. A marine propulsion system comprising:

a strut having a strut through bore extending therethrough;

an inner propeller shaft supporting a first propeller adjacent a trailing end thereof, and the inner propeller shaft having an interface, at a leading end thereof, to facilitate connection with a drive shaft for receiving torque therefrom and supplying a first portion of the torque to the first propeller as well as for transferring thrust, generated by the first propeller, along the inner propeller shaft back to the drive shaft;

an outer propeller shaft supporting a second propeller adjacent a trailing end thereof, and the outer propeller shaft surrounding a portion of the inner propeller shaft;

the inner and the outer propeller shafts both extending completely through the strut through bore;

a differential gear set being accommodated within the strut and surrounding both the outer and inner propeller shafts, the differential gear set comprising a differential input shaft, a differential output shaft and first and second idle gears, and the differential input shaft being drivingly connected to the inner propeller shaft in order to receive a second portion of the torque supplied thereto and the differential gear set reversing the second portion of the torque so that the differential output shaft drives the outer propeller shaft so as to rotate the second propeller in an opposite rotational direction than the first propeller; and a leading end of the outer propeller shaft being connected to a leading end of the inner propeller shaft to facilitate, during operation, both rotation of the outer propeller shaft with respect to the inner propeller shaft as well as transfer of thrust, generated by the second propeller, to the inner propeller shaft and back to the drive shaft.

4. The marine propulsion system according to claim 3, wherein the strut is fixedly secured to a bottom surface of a hull of a vessel by a mounting plate and a plurality of fasteners such that, following installation of the strut, the hull is sandwiched between the mounting plate and an end face of the strut.

5. The marine propulsion system according to claim 4, wherein at least one contoured spacer insert/shim is located between the bottom surface of the hull and the end face of the strut to modify an orientation/position of the strut, relative to at least one of the hull or the drive shaft, and assist with aligning the drive shaft with at least the inner and outer propeller shafts so that thrust, generated by the first and second propellers, is transferred and conveyed back along the inner and outer propeller shafts to the drive shaft.

6. The marine propulsion system according to claim 3, wherein the strut through bore extends completely through a central region of the strut, from a leading end to a trailing end thereof, and the strut through bore is sized so as to receive and accommodate components of the marine propulsion system therein.

7. The marine propulsion system according to claim 3, wherein a trailing end of the strut through bore carries an internal thread while a leading end of a through bore extension carries an external thread, and an exterior surface of the through bore extension carries a pair of spaced apart O-rings which engage with an inwardly facing surface of the strut through bore to form a watertight seal therebetween and prevent water from flowing therebetween.

8. The marine propulsion system according to claim 3, wherein the strut also includes a strut blind bore which extends from the end face of the strut toward a skeg, and the strut blind bore passes through the strut through bore and terminates prior to reaching an end portion of the skeg.

9. The marine propulsion system according to claim 3, wherein a spline, on a trailing end of the drive shaft, matingly engages with a spline of the inner propeller shaft to form a spline connection which couples those two shafts with one another while also compensating for any misalignment between at least the drive shaft and the inner propeller shaft.

10. The marine propulsion system according to claim 9, wherein the trailing end of the drive shaft, adjacent but upstream of the spline connection, has an annular groove which accommodates a mating pair of half rings, and the mating pair of half rings are sandwiched between a chamfered surface, formed in the leading end of the inner propeller shaft, and an inwardly facing chamfer formed in a shaft nut which engages with the inner propeller shaft to retain the spline connection between the drive shaft and the inner propeller shaft and prevent inadvertent separation thereof.

11. The marine propulsion system according to claim 7, wherein first rotatable fluid tight seal assembly is located between a trailing end of the inner propeller shaft and a trailing end of the outer propeller shaft to prevent water from passing between the inner and the outer propeller shafts;

a first needle bearing is located between the trailing end of the inner propeller shaft and the trailing end of the outer propeller shaft, adjacent to but upstream of the first rotatable fluid tight seal assembly, to facilitate rotation of the inner and the outer propeller shafts relative to one another;

a second rotatable fluid tight seal assembly is located between the outer propeller shaft and the trailing end of the through bore extension to prevent water from passing therebetween; and a second needle bearing is located between the outer propeller shaft and the trailing end of the through bore extension, adjacent to but upstream of the second rotatable fluid tight seal assembly, to facilitate rotation of the outer propeller shaft relative to the through bore extension.

12. The marine propulsion system according to claim 8, wherein first and second idler gears, of the differential gear set, are at least partially located within the strut blind bore, the first idler gear is support adjacent one end of a first idler gear shaft while the second idler gear is support adjacent one end of a second idler gear shaft, and both the first and the second idler gear shafts are located within the strut blind bore such that the first and second idler gears are located so as to engage with a differential input gear and a differential output gear accommodated in the strut through bore.

13. The marine propulsion system according to claim 12, wherein a first pair of tapered roller bearings support the first idler gear shaft within the strut blind bore to facilitate rotation of the first idler gear with respect to the strut, while a second pair of tapered roller bearings support the second idler gear shaft within the strut blind bore to facilitate rotation of the second idler gear with respect to the strut.

14. The marine propulsion system according to claim 3, wherein a leading end of the differential input shaft is connected to receive the second portion of the torque from the inner propeller shaft, a trailing end of the differential input shaft carries a differential input gear which matingly engages with the first and second idlers gears, and a leading end of the differential output shaft carries a differential output gear which matingly engages with the first and second idlers gears, and an inwardly facing surface of the differential output shaft carries a coupling feature which mates with a coupling feature of the outer propeller shaft to transfer torque from the differential output shaft to the outer propeller shaft.

15. The marine propulsion system according to claim 14, wherein at least one needle bearing is located between the outer propeller shaft and the differential input shaft to facilitate relative rotation of those two shafts with respect to one another;

a pair of input tapered roller bearings is provided between the differential input shaft and the strut to facilitate rotation between the differential input shaft and the strut; and a pair of output tapered roller bearing is provided between the differential output shaft and the strut to facilitate rotation between the differential output shaft and the strut.

16. The marine propulsion system according to claim 3, wherein a drive cage is integrally connected with the inner propeller shaft; and a trailing end of the drive cage is connected to the differential input shaft to transfer the second portion of the torque thereto.

17. The marine propulsion system according to claim 11, wherein a nose cone is secured to a leading end of the strut and covers the interface, a water tight seal is formed between the nose cone and the strut, and a third rotatable fluid tight seal assembly is located between a trailing end of the drive shaft and a leading end of the nose cone to prevent water from passing therebetween, and a deflector is attached to the drive shaft, immediately upstream but adjacent to the nose cone, for deflecting water away from the third rotatable fluid tight seal assembly, during operation.

18. The marine propulsion system according to claim 17, wherein watertight seals formed by the first rotatable fluid tight seal assembly, the second rotatable fluid tight seal assembly, the third rotatable fluid tight seal assembly, between the nose cone and the strut, and between a blind bore plug and a strut blind bore all cooperate with one another to define a lubricate chamber which is sealed and isolated from an external water environment so as to facilitate lubrication of rotatable components of the marine propulsion system during operation of the marine propulsion system.

19. The marine propulsion system according to claim 3, wherein the marine propulsion system is incorporated into a vessel which includes a transmission and an engine, the engine is drivingly connected to the transmission, and the transmission is drivingly connected to a leading end of the drive shaft to transfer torque thereto, and a rudder is located behind the first and the second propellers to facilitate steering of the vessel by an operator.

20. A method of using a marine propulsion system to power a vessel, the method comprising:

providing a strut having a strut through bore extending therethrough;

supporting a first propeller adjacent a trailing end of an inner propeller shaft, and forming an interface, adjacent a leading end of the inner propeller shaft, to facilitate connection with a drive shaft and receive torque therefrom, and the inner propeller shaft supplying a first portion of the torque to the first propeller as well as transferring thrust, generated by the first propeller, along the inner propeller shaft back to the drive shaft;

supporting a second propeller adjacent a trailing end of an outer propeller shaft, and surrounding the inner propeller shaft with the outer propeller shaft;

extending both the inner and the outer propeller shafts completely through the strut through bore;

accommodating a differential gear set within the strut and surrounding the outer propeller shaft with the differential gear set, the differential gear set comprising a differential input shaft, a differential output shaft and a pair idler gears;

drivingly connecting the differential input shaft to the inner propeller shaft in order to receive a second portion of the torque supplied thereto and drivingly connecting the differential output shaft to the outer propeller shaft with the differential gear set causing the second propeller to rotate in an opposite rotational direction than the first propeller; and connecting a leading end of the outer propeller shaft to a leading end of the inner propeller shaft to facilitate, during operation, both rotation of the outer propeller shaft with respect to the inner propeller shaft as well as transfer of thrust, generated by the second propeller, to the inner propeller shaft and back to the drive shaft.

* * * * *